United States Patent [19]

Ferri

[11] Patent Number: 4,635,555

[45] Date of Patent: Jan. 13, 1987

[54] SHOT PATTERN CONTROLLING DEVICE

[76] Inventor: Bernard L. Ferri, P.O. Box 769, Trinidad, Colo. 81082

[21] Appl. No.: 776,641

[22] Filed: Sep. 16, 1985

[51] Int. Cl.[4] ..... F42B 7/08

[52] U.S. Cl. ..... 102/453; 102/457

[58] Field of Search ..... 102/448–463

[56] References Cited

U.S. PATENT DOCUMENTS

| | | | |
|---|---|---|---|
| 85,149 | 2/1896 | Plottenburg . | |
| 265,370 | 2/1927 | King . | |
| 519,559 | 5/1894 | Winans . | |
| 776,918 | 12/1904 | LaDow . | |
| 875,762 | 1/1908 | Winans et al. . | |
| 1,526,972 | 5/1968 | Piegay . | |
| 4,006,688 | 2/1977 | Craft et al. . | |
| 4,151,799 | 5/1979 | Jackson | 102/451 |
| 4,167,904 | 9/1979 | Ferri | 102/457 |
| 4,506,605 | 3/1985 | Maki | 244/3.23 |

FOREIGN PATENT DOCUMENTS

| | | | |
|---|---|---|---|
| 473162 | 1/1915 | France | 102/448 |

*Primary Examiner*—Harold J. Tudor

*Attorney, Agent, or Firm*—Robert C. Dorr

[57] ABSTRACT

An improved shot compressor for use in a shotgun cartridge containing shot. The improved compressor has a plurality of equally spaced fins disposed around and integral with a centrally disposed collapsing means for controlling the pattern of opening shot as it leaves the barrel of a shotgun upon firing.

4 Claims, 14 Drawing Figures

Fig. 1
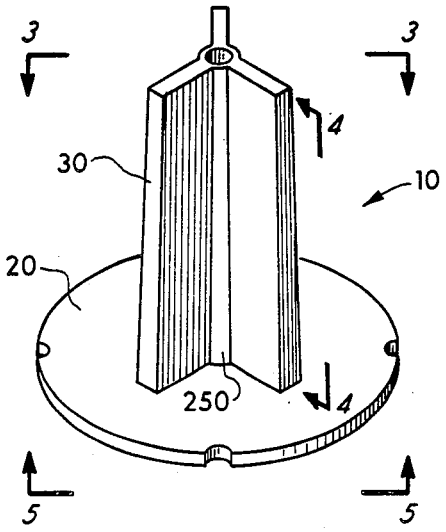
Fig. 2
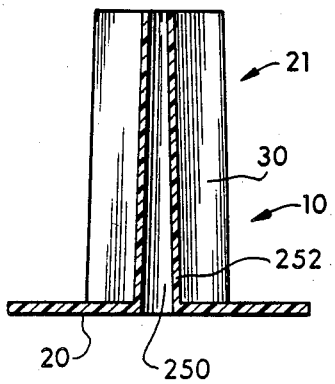
Fig. 4
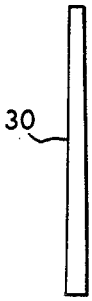
Fig. 3
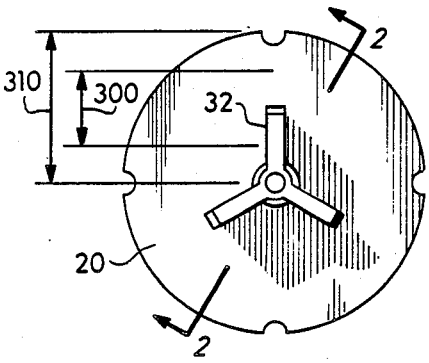
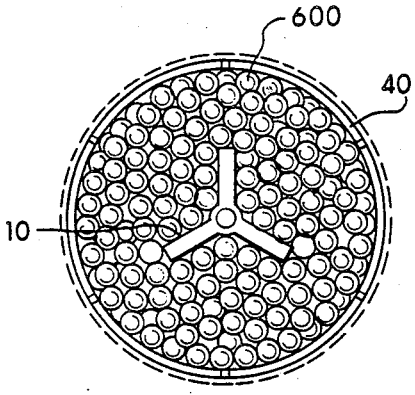
Fig. 6
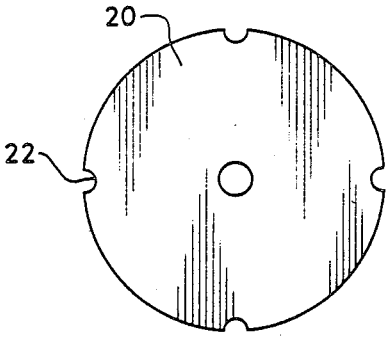
Fig. 5

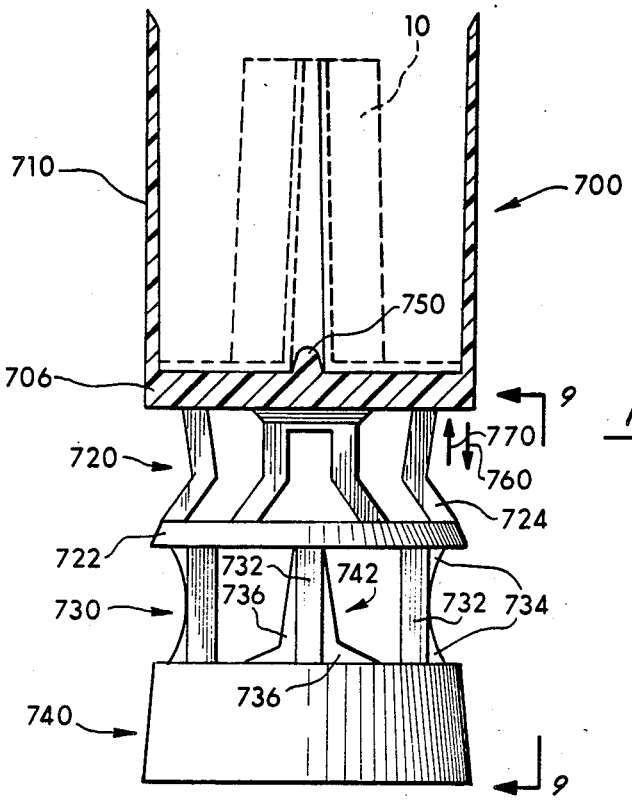
Fig. 7
Fig. 8
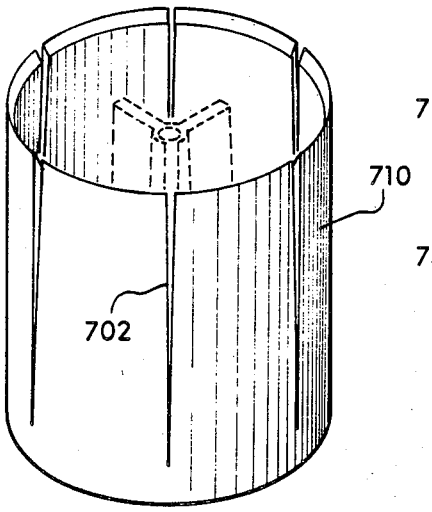
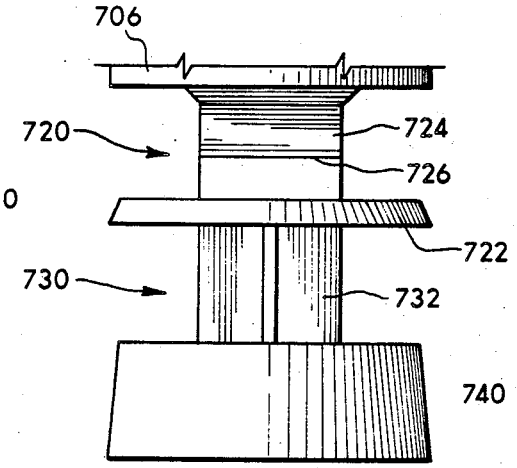
Fig. 9

SHOT PATTERN CONTROLLING DEVICE

DISCUSSION OF THE PRIOR ART

1. Field of the Invention

This invention relates to the field of shotgun cartridges and more specifically to shotgun cartridges having shot compressor devices contained therein.

2. Background of the Invention

In my earlier patent, "Shot Compressor Devices and Method Therefor", U.S. Pat. No. 4,167,904, issued on Sept. 18, 1979, I disclosed a shot compressor device comprising an upstanding tube essentially disposed internally of a shotgun cartridge with the shot disposed around the tube. When the cartridge is fired, the tube is compressed by the shot and, in the case of steel shot, barrel abrasion is minimized and generally greater distance is achieved with a tighter pattern of shot. The centrally disposed tube causes the shot to move radially inwardly as it travels through the barrel, thus minimizing the deformation of softer lead shot with the same results.

I have now improved the shot compressor of my earlier patent by providing a device for controlling the pattern of opening the shot as it leaves the barrel.

Prior to this application, I conducted a patentability search to ascertain any comparable prior art approaches. The results of that patentability search resulted in the following patents:

| Inventor | Pat. No. | Issue Date |
|---|---|---|
| Winans | 519,559 | May 8, 1894 |
| Plottenburg | 85,149 | Feb., 1896 |
| LaDow, C. | 776,918 | Dec. 6, 1904 |
| Winans, et al. | 875,762 | Jan. 7, 1908 |
| King | 265,370 | Feb. 10, 1927 |
| Piegay | 1,526,972 | May, 1968 |
| Craft, et al. | 4,006,688 | Feb. 8, 1977 |

The 1894 patent of Winans (U.S. Pat. No. 519,559) sets forth a spreader dividing the shot into three or more separate compartments. Each divider is rectangular in shape and is designed to rest upon the wad being long enough to reach the top of the shot. The 1909 Winans et al. (U.S. Pat. No. 875,762) and the 1927 King (British Pat. No. 265,370) patents describe "post-type" spreaders. The remaining patents are not as close to my invention as those described above.

SUMMARY OF THE INVENTION

This invention relates to an improvement to my U.S. Pat. No. 4,167,904 wherein the shot compressor device of that invention is improved by providing a plurality of equally spaced fins disposed around the compressor for controlling the pattern of opening the shot pattern as the shot leaves the barrel. The fins are substantially rectangular in cross-section and in shape when viewed from the side with the width of each fin being in the range of 25% to 75% of the inner radius of the cartridge. Varying the width of each fin controls the pattern opening of the shot as it leaves the barrel of the shotgun in order to uniformly disperse shot at a target.

DESCRIPTION OF THE DRAWING

FIG. 1 is a perspective view of the pattern opening device 10 of the present invention;

FIG. 2 is a cross-sectional view of the device of FIG. 1;

FIG. 3 is a top planar view of the device of FIG. 2;

FIG. 4 is a cross-sectional view of one of the fins of the device of FIG. 2;

FIG. 5 is a bottom planar view of the device of FIG. 2;

FIG. 6 is a illustration showing the placement of the shot around the device of FIG. 1 within a shotgun shell;

FIG. 7 is a side planar view, with partial cross-section cut away of a preferred wad of the present invention;

FIG. 8 is a perspective view of the upper portion of the wad of FIG. 7;

FIG. 9 is an end planar view of the lower portion of the wad of FIG. 7;

DETAILED DESCRIPTION

Figure 10:
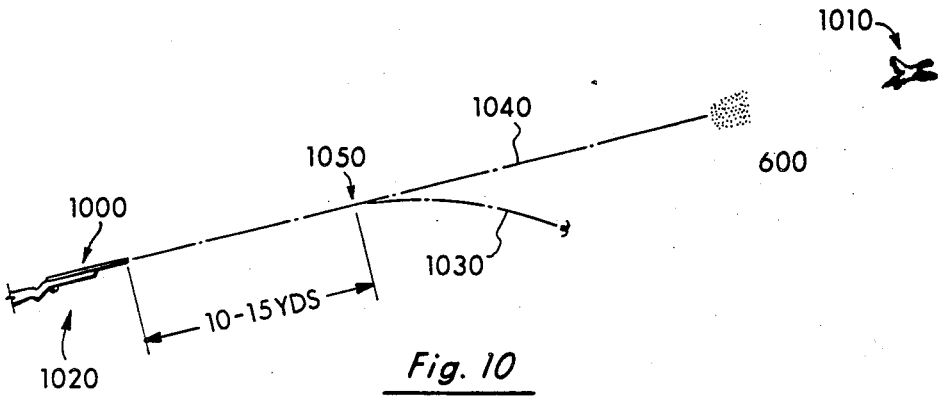
FIG. 10 is an illustration showing the device of the present invention being fired from a shotgun.

In FIG. 1 is a perspective view of the improved compressor 10 of the present invention to include a circular base 20, a hollow tube 250, and a plurality of equally spaced fins 30 integral with tube 250 and circular base 20 for use in a shotgun cartridge 40. The construction of the circular base 20 and the tube 250 is set forth in my prior patent (for example, FIGS. 13–18, thereof).

The details of the improved shot compressor 10 of the present invention is set forth in FIGS. 2–5. In FIG. 2, the improved shot compressor includes a hollow tube 250 slightly tapered from the bottom to the upper region (typically 0.060 inches to 0.040 inches). Affixed to the hollow tube 250 are the plurality of fins 30 which, in the example shown in FIGS. 1 through 4, are equally spaced at 120 degrees. In the preferred invention, three fins are utilized although the invention, like Winans, is not so limited. Each fin is substantially rectangular in shape in cross-section 32 as shown in FIG. 3 and each fin is substantially rectangular when viewed from the side as shown in FIG. 2. The fins follow the taper of the tube 250 and form an outer diameter of 0.26 inches on the bottom to 0.25 inches on the top. The slight taper of the fins 30 and the tube 250 allows the improved compressor 10 to be manufactured through means of a mold. Likewise, the thickness of each fin 30 varies from the bottom to the top such as, 0.05 inches to 0.04 inches. In the preferred embodiment, the tube 250 is hollow and is made of solid material that collapses as taught by my earlier patent. The circular base 20 has a plurality of notches 22 formed around the outer circumference of the base for the following reasons. The notches 22 are designed to fit wads containing buttressed petals (buttressed petal wads have four upstanding posts or bars which stiffen the upright petals).

The circular base 220 is designed to fit within conventional shotgun wads, hence the outer diameter of base 20 substantially equals the inner diameter of the cartridge 40 or of a suitable wad. The height of the improved compressor 10 of the present invention equals the substantial height within cartridge 40 or the wad.

As shown in FIG. 3, the width of each fin 30 varies in a preferable range between a range 300 which is preferably 25% to 75% of the inner radius of the cartridge 40. Or, substantially 25% to 75% of the outer radius 310 of disk 20. Control of the opening of the pattern occurs with a width less than radius 310 so that the shot can fit around the outer edges of the fins 30 as shown in FIG. 6 with primary control within the aforesaid range. The shot 600 is shown in FIG. 6 disposed around the device 10 of the present invention and, therefore, the outer limit for the width of each fin 30 would be the radius 310 of disk 20 less the diameter of the shot plus tolerances.

A cross-section of the wad 700 of the present invention is shown in FIG. 7 to include a plurality of segments 710 disposed above a cushion 720 and a brace 730. The brace 730 is mounted on a base 740.

The details of each of the segments 710 are shown in FIG. 8 and include a plurality of slits 702 disposed between the segments 710. The segments 710 are attached to a base 706 and centrally mounted on that base 706 is an upstanding nub 750. As shown in FIG. 7, and in the preferred embodiment of the shot cup, the improved compressor 10 of the present invention is designed to have the lower end 252 of the tube 250 firmly fit over nub 750 to hold the improved compressor 10 in the center portion of the wad 700. It is to be expressly understood that the compressor 10 could be integral with the shot cup or the disc 20 could rest in the shot cup without benefit of a nub 750. Hence, under the teachings of the present invention, the device 10 can be either inserted into the wad 710 or the device 10 can be used without a wad. Under the base 706 is a cushion area 720 which is designed to lessen the recoil caused by the firing of a cartridge in a shotgun. It further functions to provide an added force or push to the shot as the shot is released from the gun as will be explained shortly. In other words, the cushion area recoils in the direction of arrow 760 upon firing to minimize recoil and then, through spring tension, straightens out and moves the shot in the direction of arrow 770.

The cushion 720 is integral with base 706 on the upper end and base 722 on the lower end. As shown in FIG. 9, the cushion members 724 are rectangular in shape when viewed from the side and are bent inwardly at area 726. In the preferred embodiment, there are four cushion members 724 in the orientation as shown in FIGS. 7 and 9. The brace section 730 is generally comprised of three rectangular braces 732. As shown in FIGS. 7 and 9, the rectangular braces 732 have additional bracket supports 734 and 736. The brace section 730 is integral with upper base 722 and the lower thickened base 740. The center 742 of the lower base 740 is raised to provide further bracing.

Figure 11:
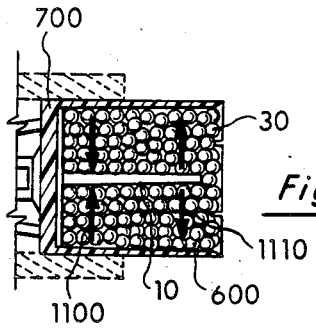
FIG. 11 is an illustration of the wad of the present invention leaving the barrel of a shotgun.
Figure 12:
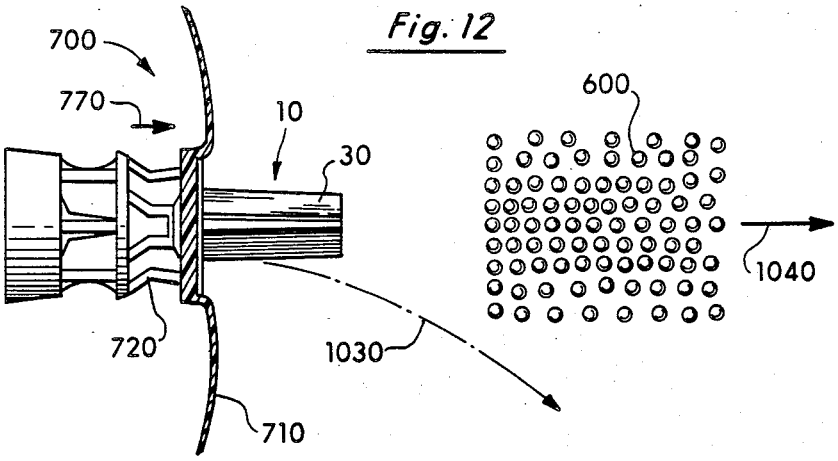
FIG. 12 is an illustration showing the separation of the shot from the wad of the present invention.

The operation of the present invention is shown in FIGS. 10–12. In FIG. 10, a conventional shotgun shell 1000 is aimed at a target such as a bird 1010. The gun 1000 is fired and the shell 1020 is discharged. The wad 700 of the present invention containing the shot travels for a given distance before being separated from the shot 600 (an example of 10 to 15 yards is shown, but varies according to the amount of powder, type of shot, etc.). The wad 700 including the compressor 10 of the present invention then follows a trajectory 1030 to the ground. The shot 600 continues along the path 1040 until hitting the target 1010 which is typically located forty yards from the gun 1000. This is similar to FIG. 1 of my earlier patent.

In FIG. 11, the compressor moves inwardly as shown by arrows 1100 while traveling through the barrel of the gun 1000. However, the fins 30 cause a slight opening of the shot 600 in the direction of arrow 1110. At this point in time, but not shown in FIG. 11, the cushion members 720 are fully compressed downwardly in the direction of arrow 710.

In FIG. 12, the shot 600 is separating from the wad 700 at point 1050 of FIG. 10. From the point in time that the wad 700 leaves the gun, as shown in FIG. 11, to the point in time of separation, as shown in FIG. 12, the compressed cushion members 720 are moving outwardly in the direction of arrow 770 to provide a push to the shot 600. In addition, the fins 30 of the improved compressor 10 of the present invention have acted upon exit from the gun 1000, to control the opening of the shot 600.

While the discussion of events occurring in FIGS. 1 through 12 are believed correct, it is to be expressly understood that no actual testing at the times of FIGS. 10, 11, and 12 have occurred through instantaneous photographic techniques to verify the above analysis.

Figure 13:
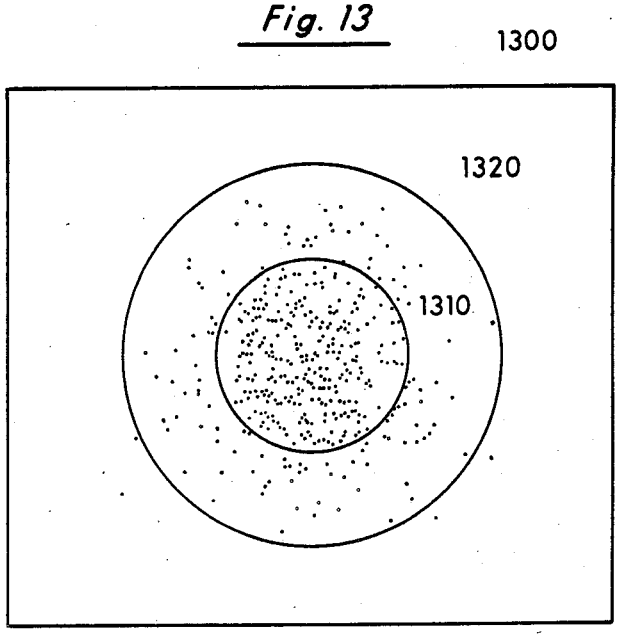
FIG. 13 is a chart illustrating the results of firing a shotgun without the pattern opening device of the present invention.
Figure 14:
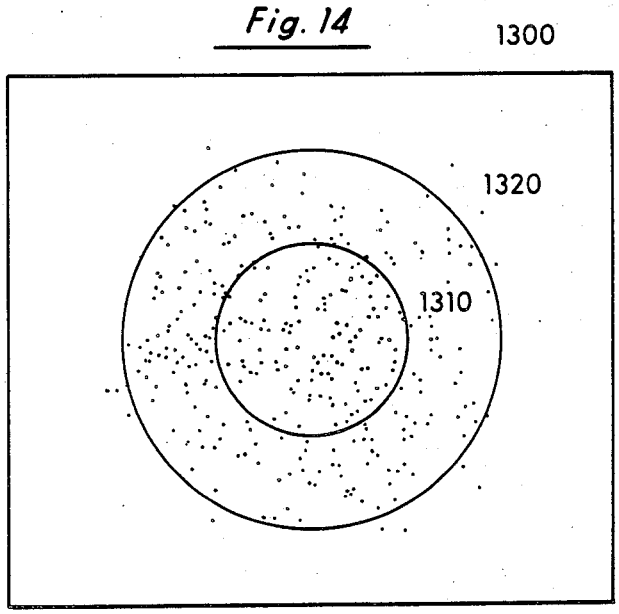
FIG. 14 is a chart illustrating the shot patterns fired from the shotgun using the wad and device of the present invention.

The results of using the improved compressor of the present invention are shown in FIGS. 13 and 14. In FIG. 13, a target 1300 was placed at twenty-five yards. A shell without the improved compressor of the present invention was fired resulting in 274 pellets within the interior circle of 1310 and 122 pellets hitting between circle 1310 and circle 1320.

In FIG. 14, the same gun was used to fire a shell loaded with the improved compressor of the present invention. The target 1300 again was placed at twenty-five yards and 128 pellets were found within circle 1310 and 204 pellets were found between circles 1310 and 1320. This resulted in a fairly even distribution of the shot over a much larger area than the narrow and uneven distribution of the shot without utilizing the compressor of the present invention. The test was based upon a Merkel shotgun using a potential hunting reload assembled as:

Winchester AA Case
Winchester 209 Primer
23.0 Grains of Unique
Windjammer wad
$1\frac{1}{8}$ ounces $7\frac{1}{2}$ Copper-plated shot While FIGS. 13 and 14 show the targets for one test, an average for three patterns in the test resulted in:

| Load | Core | Ring |
|---|---|---|
| Without Device 10 | 272 | 120 |
| With Device 10 | 129 | 206 |

In addition, a chamber pressure was conducted for the shotgun based upon the following parameters:

Winchester AA Case
Winchester 209 Primer
19.0 Grams of Trap-100
Winchester WAA12 (white wad)
$1\frac{1}{8}$ Ounces $7\frac{1}{2}$ shot The results of this test conducted on the 30 inch full choke test barrel while working at a temperature of 80 degrees Fahrenheit are:

| Load | Pressure | Velocity |
|---|---|---|
| Without Device 10 | 8,900 | 1,178 |
| With Device 10 | 9,100 | 1,193 |

Hence, the improved compressor of the present invention increases barrel pressure and the resultant velocity of the shot as well as controls the pattern of the shots to provide a more even and wider distribution of the shot.

Although the present invention has been described with a certain degree of particularity, it is understood that the present disclosure has been made by way of example and that changes and details of structure may be made without departing from the spirit thereof.

I claim:

1. A device for use in a shotgun cartridge for controlling the opening pattern of said shot as said shot leaves the barrel of said shotgun when said cartridge is fired, said device comprising:

an elongated center support centrally located in said cartridge, a plurality of equally spaced fins disposed around and integral with said center support for controlling the pattern of opening said inwardly directed shot as said shot leaves said barrel, said fins extending the elongated length of said center support, said fins slightly tapering inwardly from the bottom of said cartridge to the top of said cartridge, each of said fins being substantially rectangular in cross-section and substantially rectangular in shape when viewed from the side, a circular base connected under said center support and said fins, said circular base having a formed opening centrally disposed therein, and a wad engaging said circular base for centrally holding said central support and said fins in said wad, said wad comprising:

(a) a first circular region having an upper surface with a formed upstanding nub thereon, press fittingly engaging said formed opening for holding said circular base to said wad, said circular base resting upon the upper surface of said first circular region, (b) means integral with and located under said first circular region and being further integral with and located above a second circular region for cushioning said shot in said wad to reduce the force of recoil when said shotgun cartridge is fired, said cushioning means being capable of pushing said shot as said shot leaves said barrel, and (c) means integral with and located below said second circular region and being further integral with and located above a third circular region for bracing said wad as said cartridge is fired.

2. The device of claim 1 in which said center support is a tube.

3. The device of claim 1 in which the width of each said fin is in the range of 25% to 75% of the inner radius of said cartridge.

4. A device for use in a shotgun cartridge for controlling the opening pattern of said shot as said shot leaves the barrel of said shotgun when said cartridge is fired, said device comprising:

an elongated center tube centrally located in said cartridge, a plurality of equally spaced fins disposed around and integral with said center tube for controlling the pattern of opening said inwardly directed shot as said shot leaves said barrel, said fins extending the elongated length of said center tube, said fins slightly tapering inwardly from the bottom of said cartridge to the top of said cartridge, each of said fins being substantially rectangular in cross-section and substantially rectangular in shape when viewed from the side, the width of each said fin being in the range of 25% to 75% of the inner radius of said cartridge, a circular base connected under said center tube and said fins, said circular base having a formed opening centrally disposed therein, and a wad engaging said circular base for centrally holding said central tube and said fins in said wad, said wad comprising:

(a) a first circular region having an upper surface with a formed upstanding nub thereon, press fittingly engaging said formed opening for holding said circular base to said wad, said circular base resting upon the upper surface of said first circular region, (b) means integral with and located under said first circular region and being further integral with and located above a second circular region for cushioning said shot in said wad to reduce the force of recoil when said shotgun cartridge is fired, said cushioning means being capable of pushing said shot as said shot leaves said barrel, and (c) means integral with and located below said second circular region and being further integral with and located above a third circular region for bracing said wad as said cartridge is fired.

* * * * *